United States Patent [19]

Oxenrider et al.

[11] 4,435,294

[45] Mar. 6, 1984

[54] POLYCYCLIC PYROMELLITATES AND USE THEREOF ON POLYESTERS AND POLYAMIDES

[75] Inventors: Bryce C. Oxenrider, Florham Park; David J. Long, Stanhope, both of N.J.

[73] Assignee: Allied Corporation, Morris Township, Morris County, N.J.

[21] Appl. No.: 429,945

[22] Filed: Sep. 30, 1982

[51] Int. Cl.[3] ..... C07C 153/07; D06M 13/20

[52] U.S. Cl. ..... 252/8.6; 252/8.8; 560/76; 560/87; 560/88; 260/455 R; 556/413

[58] Field of Search ..... 252/8.8, 8.6; 560/87, 560/88, 76; 260/455 R; 556/413

[56] References Cited

U.S. PATENT DOCUMENTS

| | | | |
|---|---|---|---|
| 3,994,951 | 11/1976 | Sandler | 252/8.75 |
| 4,192,754 | 3/1980 | Marshall et al. | 252/8.8 |
| 4,209,610 | 6/1980 | Mares et al. | 260/40 R |
| 4,252,982 | 2/1981 | Oxenrider | 560/87 |
| 4,321,403 | 3/1982 | Oxenrider et al. | 560/87 |

*Primary Examiner*—Maria Parrish Tungol

*Attorney, Agent, or Firm*—Alan M. Doernberg; Gerhard H. Fuchs

[57] ABSTRACT

Oligomers containing pyromellitic rings, divalent linking groups, pendant fluoroalkoxy or hydrocarbon alkoxy groups and pendant polar groups of various kinds impart soil repellency to fibers that persists after repeated laundering. An exemplary material is prepared by the reaction of pyromellitic difluoroester/diacid chloride with 1,4-butanediol (the linking group) and 3-chloro-1,2-propanediol (the pendant polar group).

18 Claims, No Drawings

POLYCYCLIC PYROMELLITATES AND USE THEREOF ON POLYESTERS AND POLYAMIDES

DESCRIPTION

Pyromellitic anhydride esterified with both fluorinated alcohols and epichlorohydrin is described in U.S. Pat. No. 4,209,610 to Mares et al as a material imparting both stain and oil repellency to carpets. Additional methods for preparing this material are described in U.S. Pat. Nos. 4,252,982 to Oxenrider (1981) and 4,321,403 to Oxenrider et al (1982). Methods for applying this material in aqueous emulsion to fibers are described in U.S. Pat. No. 4,192,754 to Marshall et al (1980)

Such pyromellitate material as prepared have been found to contain (generally under 20%) a higher molecular weight material formed by reaction of the epichlorohydrin-derived moiety with, and elimination of one fluorinated alcohol from, a second molecule of the pyromellitate. This product would have two rings, three fluorinated chains, three free epichlorohydrin-derived groups and one linking group which might be —CO—$CH_2$—CH($CH_2$Cl)—O—CO—. It has been discovered by Robert H. Thomas et al. (commonly assigned U.S. Ser. No. 350,544, filed Feb. 19, 1982) that pyromellitate compositions with higher amounts of this higher molecular weight material have improved retention of properties on fibers. Unfortunately, the proportion of such materials is not subject to precise control and, more importantly, its use involves loss of expensive fluorinated alcohol-derived groups from the pyromellitate in a form (free alcohol) that will not adhere well to fibers.

BRIEF DESCRIPTION OF THE INVENTION

The invention includes, in one form, a composition comprising a polycyclic compound of the formula:

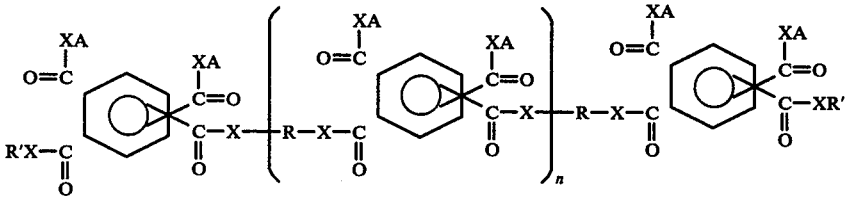

wherein X is independently at each occurrence —O—, —S—, —N($CH_3$)— or —NH—; wherein A is alkyl of 2-24 carbons or —R″—$(CF_2)_pCF_3$ with R″ being alkylene of 1-6 carbons and p being an integer of 3-15; wherein R′ is a monovalent radical selected from the group consisting of —$CH_2$CH(OH)$CH_2$Cl, —$CH_2$CH(OH)$CH_2$Br, —CH($CH_2$OH)($CH_2$Cl), —CH($CH_2$OH)($CH_2$Br), —$(CH_2)_m$Cl, —$(CH_2)_m$Br, —CH($CH_2$Cl)$_2$, —CH($CH_2$Br)$_2$,

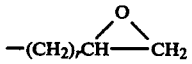

and —$(CH_2)_q$-Si(OR‴)$_3$, with m being an integer of 1-8, q being an integer of 1-8, r being an integer of 1 to 12 and R‴ being alkyl of 1-3 carbons; wherein R is a divalent radical selected from the group consisting of alkylene of 2-6 carbons, —$CH_2$CH($CH_2$Cl), —$CH_2$C($CH_2$Cl)$_2$$CH_2$—, —$CH_2$C($CH_2$OH)$_2$$CH_2$—, —$CH_2$CH=CH$CH_2$—, 1,3-phenylene and 1,4-phenylene; n is an integer of 0-20; or mixtures of such polycyclic compounds with different values of n or of such polycyclic compounds with different values of n and with the monocyclic compound:

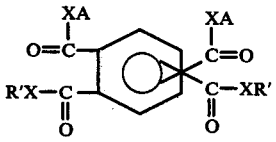

In all such formulae the crossing of bonds on the right side of each ring is intended to indicate that a mixture is present of rings with —CO—XA groups 1,3 and 1,4 on the ring. It should be appreciated that the larger n is for a polycyclic compound, the more isomers will actually be present with different combinations of such 1,3 and 1,4 substituted rings. When the —CO—XA groups are 1,3, other substituents are 4,6. When the —CO—XA groups are 1,4 the other substituents are 3,6.

The present invention also includes methods comprising applying the above composition to a polyester or polyamide fiber and polyester and polyamide fibers having applied thereto the above composition.

DETAILED DESCRIPTION OF THE INVENTION

The polycyclic pyromellitate oligomers and mixtures thereof with monocyclic compounds can be considered mixed pyromellitate esters (and amides) based upon the following structures:

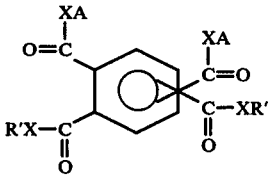

monomer structure

-continued

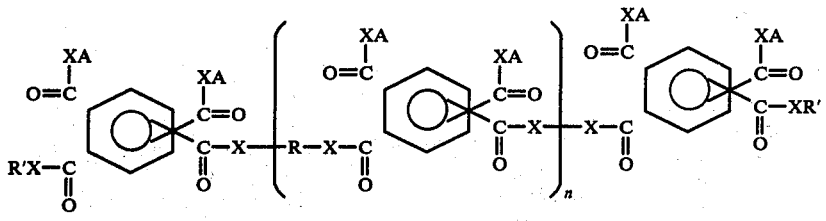

oligomer structure

The monomer structure shows two groups —C(O)XA (either 1,3 or 1,4) and the oligomer structure has two group —C(O)XA on each ring (either 1,3 or 1,4 on each ring). These groups may be derived from fluoroalcohols, fluorothiols, fluoroamines or fluoromethylamines, (X being —O—, —S—, —NH— or —N($CH_3$)—, respectively) with fluoroalcohols being preferred. Among the fluoroalcohol-derived groups, preferred compounds are those derived from fluorinated hydrocarbyl ethanols represented by the formula $CF_3(CF_2)_pCH_2CH_2O$— where p may be 3–15 or even larger, but is preferably 3–13. Slightly less preferred are those derived from fluorinated hydrocarbyl propanols and from fluorinated hydrocarbyl butanols; $CF_3(CF_2)_pCH(CH_3)$—$CH_2O$— and $CF_3(CF_2)_p(CH_2)_4O$—. Substituents A with alkylenes of 1–6 carbons other than 1,2-ethylene, 1,2-propylene or 1,4-butylene may also be used, but are less preferred. Similarly less preferred are compounds of any of these formulae with —O— replaced by —S—, —NH— or —N($CH_3$)—.

In separate polycyclic compounds from those containing fluorinated —XA substituents, hydrocarbyl —XA substituents may be used. Monomers of this type are described in a copending commonly assigned application of Oxenrider and Price, Ser. No. 374,840, filed May 5, 1982. The corresponding polycyclic compounds, with —R— groups are described below, and mixtures thereof with monocyclic compounds of the fluorinated and nonfluorinated type and with fluorinated polycyclic compounds are covered by the present invention. In these non-fluorinated polycyclic oligomers, A may be alkyl of 2–24 carbons, and is preferably alkyl of 14–20 carbons.

The substituent —C(O)—XR′ appears in two positions on the monocyclic compounds and in one position on each of exactly two rings (regardless of the total number of rings except if branching occurs) in the polycyclic compounds. This substituent may be any of a variety of groups which tend to bond, link or otherwise associate with fiber samples. These include groups where R′ is

R′

(1) —$CH_2CH(OH)CH_2Cl$ and —$CH(CH_2OH)(CH_2Cl)$
(2) —$CH_2CH(OH)CH_2Br$ and —$CH(CH_2OH)(CH_2Br)$
(3) —$(CH_2)_mCl$ m=1–8
(4) —$(CH_2)_mBr$ m=1–8
(5) —$CH(CH_2Cl)_2$
(6) —$CH(CH_2Br)_2$
(7) —$CH(CH_2OH)_2$

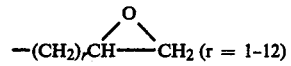

(8)

(9) —$(CH_2)_qSi(OR''')_3$ q=1–8 R‴ alkyl of 1–3 carbons.

Monomers having substituents (1) and (2) are described in U.S. Pat. No. 4,209,610 and are derived from the partial ester of pyromellitic acid having two —C(O)XA groups and two carboxyl groups, which are reacted with oxiranes (e.g. epichlorohydrin) to give the desired substituents. By using diester/diacid chlorides of the formula

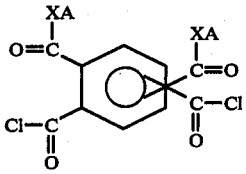

as described more fully in copending commonly assigned application Ser. No. 429,947, filed Sept. 30, 1982, of Oxenrider and Long, the monocyclic compounds can be prepared by reaction with R′OH, R′SH, R′$NH_2$ or R′$NHCH_3$. Specifically, compounds with substituents shown as (1) and (2) above are prepared by reacting the diester/diacid chloride with $CH_2(OH)CH(OH)(CH_2Cl)$ and $CH_2(OH)CH(OH)(CH_2Br)$ with reaction at the 1-hydroxy and at the 2-hydroxy in various proportions. These reactions occur under mild conditions in various solvents (e.g. butyl acetate or ethyl acetate) in the presence of an acid acceptor such as triethylamine or pyridine.

Monocyclic compounds having, as R′, substituents (5) and (6) are described in copending applications of Oxenrider and Long Ser. No. 431,452, filed Sept. 30, 1982. Monocyclic compounds having, as R′, epoxy substituent (8), are described in copending applications of Oxenrider and Long Ser. No. 429,947, filed Sept. 30, 1982. Monocyclic compounds having, as R′, silyl substituent (9) are described in copending application of Oxenrider and Long Ser. No. 429,946, filed Sept. 30, 1982. These three applications of Oxenrider and Long Ser. Nos. 431,452, 429,947 and 429,946, are each filed herewith and commonly assigned. Each is incorporated herein by reference, to the extent not inconsistent, particularly regarding suitable examples of such R′ groups, suitable reagents to provide such R′ groups and suitable conditions for applying compounds containing such R′ groups. In addition, the mixtures of polycyclic compounds with monocyclic compounds of the present invention include the materials of each of these applications as suitable monocyclic compounds.

When preparing polycyclic compounds, however, both monovalent reactants R'XH and divalent reactants HX—R—XH are used. The proportion of monovalent and divalent reactants will affect the distribution of monocyclic compounds and polycyclic compounds with various values for n that are produced. Preferred divalent radicals R and the corresponding reactants HXRXH are listed below, where X is —O—:

| R | reactant |
|---|---|
| (9) alkylene of 2-6 carbons | diols of 2-6 carbons |
| (10) $CH_2C(CH_2Cl)_2CH_2$ | dichloropentaerythritol |
| (11) $CH_2C(CH_2Br)_2CH_2$ | dibromopentaerythritol |
| (12) $CH_2C(CH_2OH)_2CH_2$ | pentaerythritol |
| (13) 1,3 and 1,4 phenylene | hydroquinone, resorcinol |
| (14) $—CH_2CH=CHCH_2—$ | 2-butene-1,4-diol |
| (15) $CH_2CH(CH_2Cl)$ | 3-chloro-1,2-propanediol |

Similar compounds with —O— replaced by —S—, —NH— and $—N(CH_3)—$ may also be used. Preferred instances of R being alkylene are $—(CH_2)_4—$ and $—(CH_2)_6—$ derived from butylene glycol and hexamethylene glycol, respectively.

The polycyclic compounds may be prepared by reacting diester/diacid chlorides of the above formula with mixtures of R'XH and HXRXH. Equal mixtures of these two reactants would be expected to produce a statistical mixture of compounds with an average of two rings per compound. An example of this distribution is approximately 25% monocyclic compounds, 50% dicyclic compounds (n=0) and 25% tricyclic compounds (n=1) and possibly higher compounds (n=2 or more). Similarly, other statistical distributions can be achieved by reaction of both R'XH and HXRXH with the diester/diacid chloride. Non-statistical distributions can be achieved by mixing mixtures so prepared with monocyclic compounds prepared in accordance with U.S. Pat. Nos. 4,209,610 or 4,252,982 or 4,321,403. Nonstatistical mixtures or even isolated polycyclic compounds (with regard to n values, but not to positional isomers) can be prepared by subjecting statistical mixtures so prepared to conventional separation techniques such as paper chromatography, electrophoresis or high-pressure liquid chromatography. It is preferred, however, to use statistical mixtures either as prepared or in admixture with monocyclic compounds. In the latter case, it is contemplated that A can be fluorinated hydrocarbyl for the statistical mixture and hydrocarbyl for the added monocyclic compound or vice-versa.

The compounds and mixtures of the present invention may be applied to various fibers, and especially polyamides and polyesters, in the manner used for monocyclic compounds as described in U.S. Pat. No. 4,209,610 (in organic solution) or in U.S. Pat. No. 4,192,754 (in aqueous emulsions). The treatment levels of monocyclic and polycyclic compounds, together on a weight basis, are generally comparable, with 0.05-1%, by weight of fibers. Preferred fibers are polycaproamide, poly(hexamethylene diamine adipate) and poly(ethylene terephthalate).

In general, fibers with the present polycyclic compounds or mixtures thereof with monocyclic compounds will have good initial oil and soil repellency (on a comparable weight basis). After use and cleaning (as approximated by standard laundering tests) the retention of oil and soil repellency is expected to be good.

EXAMPLE 1

A mixture of meta and para isomers of the diester of pyromellitic anhydride and a mixture of fluorinated alcohols was prepared and isolated in accordance with the procedures of U.S. Pat. No. 4,252,982 to Oxenrider. This diester can be represented by the formulae:

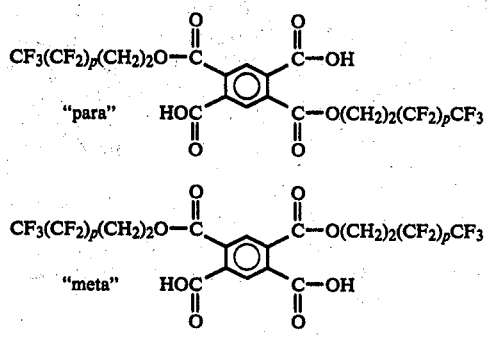

The values for p were 5, 7, 9 and 11 since a mixture of fluorinated alcohols had been used. A portion of this mixture of pyromellitate diesters (50.0 g, 83 meq) was suspended in 225 mL ethyl acetate at 65° C. for one minute under nitrogen atmosphere in a 500 mL round-bottom flask. The suspension was then cooled to 50° C. Oxalyl chloride (7.2 mL, 83.0 mmol) in 25 mL ethyl acetate was added over 5 minutes and the diester/diacid chloride product solution was stirred at 50° C. for 3 hours. Vigorous evolution of gas was observed. A reactant mixture was separately prepared of 3-chloro-1,2-propanediol (3.5 g, 41.5 mmol), 1,4-butanediol (1.8 mL, 20.8 mmol), triethylamine (23 mL) in ethyl acetate (50 mL). The reactant mixture was then added to the diester/diacid chloride solution over 10 minutes at 50°-60° C. The product solution was then stirred at 60° C. for 18 hours.

The product solution was then worked up by filtering and drying on a rotary evaporator. The resultant oil weighed 58 g. Its structure was confirmed by proton and carbon-13 nmr to be a mixture of monocyclic and polycyclic compounds of the above formulae (with $R=—(CH_2)_4—$, $R'=CH_2CH(OH)CH_2Cl$ and $A=—(CH_2)_2(CF_2)_pCF_3$) with a weight average of two rings. The oil had a surface tension of 9 dynes/cm by the procedures of Zisman.

EXAMPLE 2

The procedure of Example 1 was repeated using 50 g (83.0 meq) of pyromellitate diester mixture, 7.2 mL (83 mmol) of oxalyl chloride, 5.2 mL (62 mmol) of 3-chloro-1,2-propanediol, 0.97 mL (11 mmol) of 1,4-butanediol and amounts of triethylamine and ethyl acetate similar to those used in Example 1. The product, worked up as in Example 1, was a 57 g oil and showed a surface tension of 9 dynes/cm. Its structure, confirmed by proton and carbon-13 nmr, indicated a similar structure to the product of Example 1 with a greater proportion of monocyclic compounds compared to polycyclic compounds. The expected statistical distribution would include approximately 40-50% of the three isomers of dicyclic compounds (n=0) and 40-50% of approximately the meta and para isomers of the monocyclic compound and less than 10% of the larger polycyclic compounds (n=1 or more), all by weight.

EXAMPLE 3

A portion of the same mixture of meta and para pyromellitate diesters (20 g, 34.8 meq) was stirred in 25 mL of ethyl acetate at 45° C.; and then 3.7 mL (35 mmol) of oxalyl chloride in 10 mL ethyl acetate was added over 30 minutes. After stirring at 45° C. for 3 hours, the product (solution) was dried on a rotary evaporator to obtain 20.8 g of the intermediate diester/diacid chloride (mixture of meta and para isomers). Ethyl acetate (75 mL) was added to the product (less an aliquot for analysis) and dissolved at 45° C. A mixture of 3-bromopropanol (1.5 mL, 17.4 mmol), 1,6-hexanediol (1.0 g, 8.7 mmol) and triethylamine (4.83 mL, 34.8 mmol) in ethyl acetate (10 mL) was then added over 15 minutes and the reaction mixture stirred for two hours at 45° C. and then 18 hours at room temperature. The product solution was filtered and evaporated on a rotary evaporator to yield 22.5 g of an oil, whose structure was confirmed by proton nmr analysis.

EXAMPLE 4

The procedure of Example 1 was repeated using 150 g (251 meq) of pyromellitate diester mixture, 21.8 mL (251 meq) of oxalyl chloride, 17.8 ml (213 meq) of 3-chloro-1,2-propanediol, and amounts of triethylamine and ethyl acetate proportional to those used in Example 1. The product, worked up as in Example 1, was an oil (165 g) and showed a surface tension of 9 dynes/cm. Its structure, confirmed by nmr, indicated a greater proportion of monocyclic compounds compared to polycyclic compounds.

EXAMPLE 5

Aliquots of the products of Examples 1, 2 and 4 were diluted with acetone and were applied to tricot nylon 6 swatches at an application level of 0.25%. The oil repellency by the procedures of AATC 118-1966 gave an initial value as indicated in Table 1. After laundry cycling (washing and drying) of indicated swatches 1-8 times, similar oil repellency measurements were made and the results are displayed in Table 1. The procedure was then repeated with swatches of poly(ethylene terephthalate) (PET), and the results after 0-10 laundry cycles are indicated in Table 2.

TABLE 1

| | Nylon 6 Oil Repellency Ratings After 0-8 Laundry Cycles | | | | | | | | | | | |
|---|---|---|---|---|---|---|---|---|---|---|---|---|
| Product of Example | 1 | 1 | 1 | 1 | 2 | 2 | 2 | 2 | 4 | 4 | 4 | 4 |
| Anneal Temp (°C.) | 100 | 120 | 140 | 155 | 100 | 120 | 140 | 155 | 100 | 120 | 140 | 155 |
| Laundry Cycles | | | | | | | | | | | | |
| 0 | 7 | 7 | 7– | 7– | 7 | 6 | 7 | 7 | 6 | 6 | 6 | 6 |
| 1 | 6 | 6 | 6 | 6 | 6 | 6 | 6 | 6 | 5– | 6 | 6 | 6 |
| 2 | 6 | 6 | 6 | 6 | 5– | 5– | 6 | 6 | 3 | 4 | 6– | 6– |
| 3 | 3 | 6 | 6 | 6 | 3– | 3– | 6 | 6 | 0 | 2 | 5 | 5 |
| 4 | 2 | 5 | 5 | 5 | 2 | 2 | 5 | 5 | — | — | 4– | 4 |
| 5 | — | 2 | 4 | 5 | — | — | 5– | 5– | — | — | 3 | 3 |
| 6 | — | — | 4 | 4 | — | — | 4 | 4 | — | — | 2 | 2 |
| 7 | — | — | 3 | 4 | — | — | 2 | 3 | | | | |
| 8 | — | — | 2 | 2 | — | — | — | 2 | | | | |

TABLE 2

| | PET Oil Repellency Ratings After 0-10 Laundry Cycles | | | | | |
|---|---|---|---|---|---|---|
| Product of Example | 1 | 1 | 2 | 2 | 4 | 4 |
| Anneal Temp (°C.) | 140 | 155 | 140 | 155 | 140 | 155 |
| Laundry Cycles | | | | | | |
| 0 | 7– | 7– | 7– | 7– | 7– | 7– |
| 1 | 6 | 6 | 6 | 6 | 6– | 6– |
| 2 | 6 | 6 | 6 | 6 | 5 | 5 |
| 3 | 6 | 6 | 6 | 6 | 5 | 5– |
| 4 | 6– | 5 | 6 | 5 | 4 | 4 |
| 5 | 5 | 5 | 5 | 5 | 4 | 4 |
| 6 | 5 | 5 | 5 | 5 | 4 | 3 |
| 7 | 5 | 5 | 4 | 5 | 3 | 3 |
| 8 | 4 | 5 | 3 | 4 | 3 | 3 |
| 9 | 4 | 4 | 3 | 3 | 2 | 2 |
| 10 | 3 | 3 | 2 | 3 | — | — |

Swatches of both nylon 6 and PET coated with each product and annealed at 140° C. were also analyzed for percent fluoride by standard techniques. The results are displayed (for two replications) in Table 3. Where both replications gave the same value, it is listed once; otherwise both values are given.

TABLE 3

| | Percent F | |
|---|---|---|
| Product of Examples | Coated On Nylon 6 | Coated On PET |
| 1 | 0.14, 0.13 | 0.12 |
| 2 | 0.15 | 0.12 |
| 4 | 0.16, 0.15 | 0.10, 0.09 |

The procedures of this Example 5 were then repeated with two products as in Example 1, but with a higher ratio of butanediol:epichlorohydrin designed to give average values for n of 1 (on average three pyromellitate rings) and 3 (on average five pyromellitate rings). The products performed in an essentially equivalent fashion to the product of Example 1 on both nylon 6 and PET swatches.

What is claimed:

1. A composition comprising a polycyclic compound of the formula:

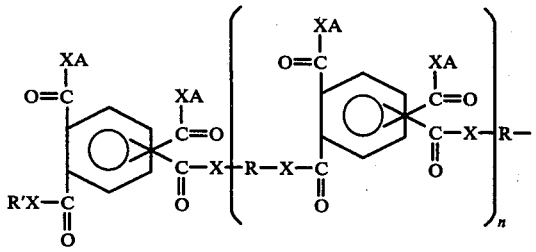

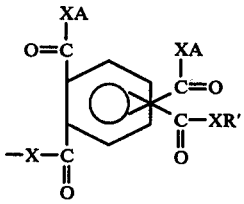

wherein X is independently at each occurrence —O—, —S—, —N($CH_3$)— or —NH—; wherein A is alkyl of 2–24 carbons or —R″—$(CF_2)_pCF_3$ with R″ being alkylene of 1–6 carbons and p being an integer of 3–13, wherein R′ is a monovalent radical selected from the group consisting of —$CH_2CH(OH)CH_2Cl$, —$CH_2CH(OH)CH_2Br$, —$CH(CH_2OH)(CH_2Cl)$, —$CH(CH_2OH)(CH_2Br)$, —$(CH_2)_mCl$, —$(CH_2)_mBr$, —$CH(CH_2Cl)_2$, —$CH(CH_2Br)_2$,

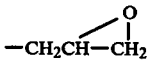

and —$(CH_2)_q$—$Si(OR'''))_3$, with m being an integer of 1–8, q being an integer of 1–8, and R‴ being alkyl of 1–3 carbons; wherein R is a divalent radical selected from the group consisting of alkylene of 2–6 carbons, —$CH_2CH(CH_2Cl)$, —$CH_2C(CH_2Cl)_2CH_2$—, —$CH_2CH{=}CHCH_2$—, 1,3-phenylene and 1,4-phenylene; n is an integer of 0–20; or mixtures of such polycyclic compounds with different values of n or of such polycyclic compounds with different values of n and with the monocyclic compound:

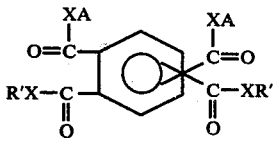

2. The composition of claim 1 wherein X is —O— in all occurrences.

3. The composition of claim 2 wherein R is alkylene of 2–6 carbons.

4. The composition of claim 1 or 2 or 3 wherein at least 80% of the compounds present in a mixture are polycyclic compounds with n being 0–3 and monocyclic compounds.

5. The composition of claim 4 wherein R′ is —$CH_2CH(OH)CH_2Cl$.

6. The composition of claim 4 wherein A is —$(CH_2)_2(CF_2)_pCF_3$ wherein p is 3–13.

7. A method which comprises applying to a polyamide or polyester fiber the composition of claim 6.

8. A method which comprises applying to a polyamide or polyester fiber the composition of claim 5.

9. A method which comprises applying to a polyamide or polyester fiber the composition of claim 4.

10. A method which comprises applying to a polyamide or polyester fiber the composition of claim 1 or 2 or 3.

11. A polyamide fiber having applied thereto the composition of claim 6.

12. A polyamide fiber having applied thereto the composition of claim 5.

13. A polyamide fiber having applied thereto the composition of claim 4.

14. A polyamide fiber having applied thereto the composition of claim 1 or 2 or 3.

15. A polyester fiber having applied thereto the composition of claim 6.

16. A polyester fiber having applied thereto the composition of claim 5.

17. A polyester fiber having applied thereto the composition of claim 4.

18. A polyester fiber having applied thereto the composition of claim 1 or 2 or 3.

* * * * *